US010932516B2

(12) United States Patent
Hogan

(10) Patent No.: US 10,932,516 B2
(45) Date of Patent: Mar. 2, 2021

(54) CONVERTIBLE FOOTWEAR

(71) Applicant: Patrick Hogan, Stoneham, MA (US)

(72) Inventor: Patrick Hogan, Stoneham, MA (US)

( * ) Notice: Subject to any disclaimer, the term of this patent is extended or adjusted under 35 U.S.C. 154(b) by 118 days.

(21) Appl. No.: 16/238,630

(22) Filed: Jan. 3, 2019

(65) Prior Publication Data

US 2019/0208856 A1 Jul. 11, 2019

Related U.S. Application Data

(60) Provisional application No. 62/614,039, filed on Jan. 5, 2018.

(51) Int. Cl.

| | |
|---|---|
| ***A43B 3/24*** | (2006.01) |
| ***A43B 13/12*** | (2006.01) |
| ***A43B 23/02*** | (2006.01) |
| ***A43B 3/12*** | (2006.01) |

(52) U.S. Cl.

CPC ..... *A43B 3/242* (2013.01); *A43B 3/12* (2013.01); *A43B 13/12* (2013.01); *A43B 23/0295* (2013.01)

(58) Field of Classification Search

CPC ..... A43B 3/242; A43B 3/12; A43B 3/246; A43B 3/24; A43B 3/248

USPC ..... 36/68, 100, 102, 105

See application file for complete search history.

(56) References Cited

U.S. PATENT DOCUMENTS 374,890 A * 12/1887 Cushman ..... A43B 1/08 36/85
905,432 A * 12/1908 Jennings ..... A43B 13/141 36/102
1,861,844 A * 6/1932 Dodge ..... A43B 3/101 36/18
2,238,804 A * 4/1941 Brown ..... A41B 11/10 36/10
2,268,967 A 1/1942 Small
2,356,490 A * 8/1944 Crotty ..... A43B 3/242 36/9 R
2,507,120 A * 5/1950 Shapiro ..... A43B 3/24 36/11.5

(Continued)

FOREIGN PATENT DOCUMENTS

CN 2794242 Y 7/2006
DE 4243490 A1 6/1994

(Continued)

*Primary Examiner* — Sharon M Prange
*Assistant Examiner* — Grace Huang
(74) *Attorney, Agent, or Firm* — Barlow, Josephs & Holmes, Ltd.

(57) ABSTRACT

The footwear can be convertible between a shoe configuration and a sandal configuration. A flexible front vamp portion can be elevated into an upwardly flexed and elevated position so it creates a cavity, in conjunction with the footwear upper portion, to receive the foot of the wearer to provide a shoe configuration. In particular, the toes of the wearer can reside in the cavity portion formed by the flexible front vamp portion. For conversion to a sandal configuration, the midsole can be removed from the outer sole and the front vamp portion can be downwardly flexed so that it collapses and then nests into the outer sole. The midsole can be replaced back into the outer sole, with the front vamp portion captured between the midsole and the outer sole, so the footwear can function as a sandal with the wearer's toes exposed.

19 Claims, 7 Drawing Sheets

(56) References Cited

U.S. PATENT DOCUMENTS 2,603,889 A * 7/1952 Lahnstein ..... A43C 11/02 36/112
2,619,744 A * 12/1952 Mattes ..... A43B 3/30 36/105
2,904,980 A * 9/1959 Stinson ..... A41B 11/10 66/171
3,329,972 A * 7/1967 Schwab ..... A43B 3/242 2/239
3,821,827 A * 7/1974 Nadler ..... A43B 15/00 12/142 C
3,878,626 A * 4/1975 Isman ..... A43B 1/0054 36/15
4,301,603 A * 11/1981 Scott ..... A61F 13/043 36/110
4,599,811 A * 7/1986 Rousseau ..... A43B 3/106 36/105
4,727,661 A * 3/1988 Kuhn ..... A43B 17/00 36/100
4,783,909 A 11/1988 Van Doren et al.
5,127,170 A * 7/1992 Messina ..... A43B 3/102 36/105
5,570,523 A * 11/1996 Lin ..... A43B 3/26 36/100
6,298,583 B1 * 10/2001 Allen ..... A43B 3/24 36/100
6,367,171 B1 * 4/2002 Burt ..... A43B 3/102 36/100
6,415,448 B1 * 7/2002 Glogover ..... A41B 11/00 2/239
6,782,642 B2 * 8/2004 Knoche ..... A43B 1/0009 36/129
7,296,367 B2 * 11/2007 Kipnes ..... A43B 3/24 36/101
7,331,122 B2 2/2008 Januszewski et al.
7,367,142 B2 * 5/2008 Ferniani ..... A43B 3/108 36/11.5
7,685,746 B2 3/2010 Kipnes et al.
7,726,045 B2 * 6/2010 Riebesell ..... A43B 23/0245 36/100
7,900,379 B2 * 3/2011 Lafortune ..... A43B 13/125 36/100
7,908,772 B2 * 3/2011 Celia ..... A43D 999/00 36/100
8,225,535 B2 * 7/2012 Dillenbeck ..... A43B 3/248 36/100
8,296,973 B2 * 10/2012 Roberti ..... A43B 5/002 36/113
8,863,406 B2 * 10/2014 Moore ..... A43B 23/0245 36/1.5
8,943,712 B2 * 2/2015 Buck ..... A43B 3/0078 36/136
8,959,795 B2 2/2015 Cristea
9,351,532 B2 * 5/2016 Mokos ..... A43B 23/0205
9,474,330 B2 10/2016 Panian et al.
9,532,622 B2 1/2017 Gillett
9,839,261 B2 * 12/2017 Hatfield ..... A43C 9/00
9,861,162 B2 * 1/2018 Kilgore ..... A43B 23/0235
9,907,363 B2 * 3/2018 Smith ..... A43C 11/1493
2007/0074425 A1 * 4/2007 Leong ..... A43B 3/102 36/68
2008/0155860 A1 7/2008 Tai
2014/0298684 A1 10/2014 Young
2015/0223554 A1 * 8/2015 Ardell ..... A43C 11/1493 36/105
2015/0366287 A1 * 12/2015 Ribeiro De Figueiredo ..... A43B 13/36 36/100
2016/0331063 A1 11/2016 Li et al.
2019/0059504 A1 * 2/2019 Hirota ..... A43B 5/06

FOREIGN PATENT DOCUMENTS

FR 2686781 A1 * 8/1993 ..... A43B 23/08
FR 2761239 A1 * 10/1998 ..... A43B 3/248
FR 2999879 A1 6/2014
WO WO-0147385 A1 * 7/2001 ..... A43B 3/102
WO 2010012851 A2 2/2010
WO 2014188082 A1 11/2014
WO 2014188083 A1 11/2014
WO WO-2020055130 A1 * 3/2020 ..... A43B 3/12

* cited by examiner

CONVERTIBLE FOOTWEAR

CROSS REFERENCE TO RELATED APPLICATION

This application claims benefit to U.S. Provisional Patent Application 62/614,039, filed Jan. 5, 2018, incorporated by reference herein in its entirety.

BACKGROUND OF THE INVENTION

There have been many attempts in the prior art to construct and provide shoes that are capable of easy and useful conversions from one type of footwear to another. For example, U.S. Pat. Nos. 2,268,967 and 4,783,909 each provide for a shoe that can convert from a shoe to a slip-on footwear by use of a flexible heel portion. U.S. Pat. No. 6,298,583 provides for collapsible shoe portions to make the footwear more compact for transport. U.S. Pat. No. 7,331,122 teaches a sandal with a pivoting heel strap to provide additional heel support when required. U.S. Pat. No. 8,959,795 teaches a flip flop footwear with an insert slipper portion to keep a wearer's feet warm, thereby requiring a separate "second attachment piece" that must be used for the conversion. U.S. Pat. No. 9,474,330 provides a collapsible heel portion to facilitate putting on and securing the footwear. U.S. Publication No. 2008/0155860 provides for a retractable toe section to provide extra protection if needed and pivoting heel section to provide additional heel support. U.S. Publication No. 2014/0298684 teaches reversible footwear but the function and structure of the footwear is substantially the same in both configurations.

These prior art attempts suffer from many disadvantages and limitations. For example, the prior art convertible footwear requires that a second separate piece be used in order carry out the conversion. Movable heel portions and reversible configurations are provided but none of them provide the ability to convert without using a separate piece.

In view of the foregoing, there is a demand for footwear that can be easily and quickly converted between a shoe configuration and a sandal configuration.

There is a further demand for convertible footwear that does not use any separate components to carry out the conversion.

There is a further demand for a convertible footwear to be easily reconfigured using existing components of the footwear thereby obviating the need to carry around a separate component for such conversion.

SUMMARY OF THE INVENTION

The invention related generally to convertible footwear, namely, footwear that can be converted from one configuration to another, such as between a shoe configuration and a sandal configuration. While this invention is particularly related to footwear that is convertible between a shoe and sandal configuration, it is pertinent to the conversion of any type of footwear configuration.

There is a need for convertible footwear in the consumer market. Many type of footwear conversions are desirable. For example, it is desirable to convert between a shoe, a slipper, a backless shoe (otherwise known as a clog or mule), and a sandal. The present invention preserves the advantages of prior art convertible footwear. In addition, the present disclosure provides new advantages not found in currently available convertible footwear and overcomes many disadvantages of such currently available convertible footwear.

The invention is generally directed to the novel and unique footwear that can be convertible between a shoe configuration, a slipper configuration, and a sandal configuration. More specifically, the footwear of the present invention can include a shoe configuration where a flexible front vamp portion is elevated into an upwardly flexed and elevated position so it creates a cavity, in conjunction with a shoe upper portion, to receive the foot of the wearer to provide a shoe configuration. In particular, the toes of the wearer reside in the cavity portion formed by the flexible front vamp portion.

For conversion to a slipper configuration, a collar portion, proximate the heel portion, can be folded outward and downward onto itself to reduce the height of the upper proximate the heel portion of the footwear. Alternatively, or additionally, for conversion to a backless shoe, the entire rear quarter, or heel, can be pushed downward towards the toe cap, such that a user's foot rests thereon when the foot is received in the shoe. In an alternative, the midsole can be removed from the outer sole and the rear quarter can be pushed downwards to nest in the outer sole, and the midsole can be reinserted into the outsole.

For conversion to a sandal configuration, the midsole can be removed from the outer sole and the front vamp portion can be downwardly flexed so that it collapses and then nests into the outer sole. The midsole can be replaced back into the outer sole with the front portion thereof resting over the nested front vamp portion. The front vamp portion can thereby be hidden without removing or adding any components, as in the prior art. In this configuration, the shoe upper portion remains in an elevated position to receive the foot of the wearer whereby the toes of the wearer are exposed thereby achieving the desired sandal configuration. The sandal configuration can be combined with the slipper configuration to create a sandal which can be slipped on. The process can be reversed to change the footwear from a sandal configuration back to a shoe configuration. Therefore, the present invention eliminates the need to carry a secondary attachment piece when closed toe covering is desired.

Therefore, an object of the present invention is to provide footwear that has the capability of being configured as a shoe, a slipper, and a sandal all with one footwear.

A further object of the present invention is to obviate the need to carry around any extra pieces or separate footwear articles to carry out such a conversion.

Yet another object of the present invention is to provide footwear that converts easily between a shoe, a slipper, and a sandal with just a few easy steps and leaves no extra pieces in the conversion process.

There is a further object of the present invention to provide an "all in one" footwear article that can convert between a shoe, a slipper, and a sandal wherever they are, on the go, without needing to carry any extra pieces or separate footwear articles.

BRIEF DESCRIPTION OF THE DRAWING FIGURES

The novel features which are characteristic of the present invention are set forth in the appended claims. However, the invention's preferred embodiments, together with further objects and attendant advantages, will be best understood by reference to the following detailed description taken in connection with the accompanying drawings in which:

DESCRIPTION OF THE INVENTION

Various embodiments are presented herein, showing various configurations of footwear. Each of the various features discloses herein can be incorporated with others of the various features, or alternatively, used individually. In general, footwear is provided having an outer sole which makes contact with the ground or other surfaces, a removable inner midsole and an upper textile portion. The upper textile portion can be formed from a number of discrete panels which can be folded, or otherwise manipulated, to permit the shoe to be reconfigured into a variety of discrete configurations. For example, the shoe can be arranged in at least four distinct configurations, A) a shoe, B) a slip-on clog; C) a slipper; and D) a sandal. Advantageously, the various flexible materials used, in conjunction with a removable and lockable midsole, allow for a single shoe to be modified into the various configurations.

Figure 1:
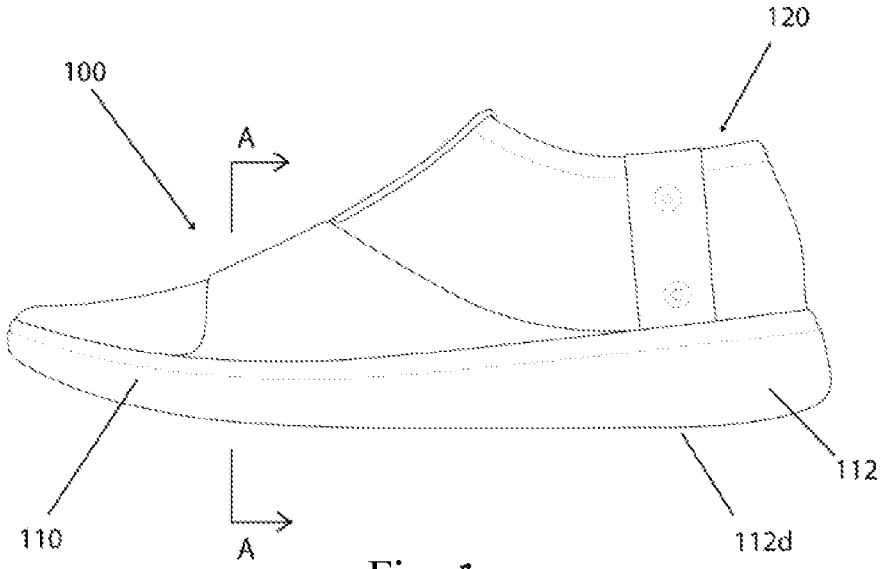
FIG. 1 shows side elevation view of a footwear of the present invention according to a first embodiment.
Figure 2:
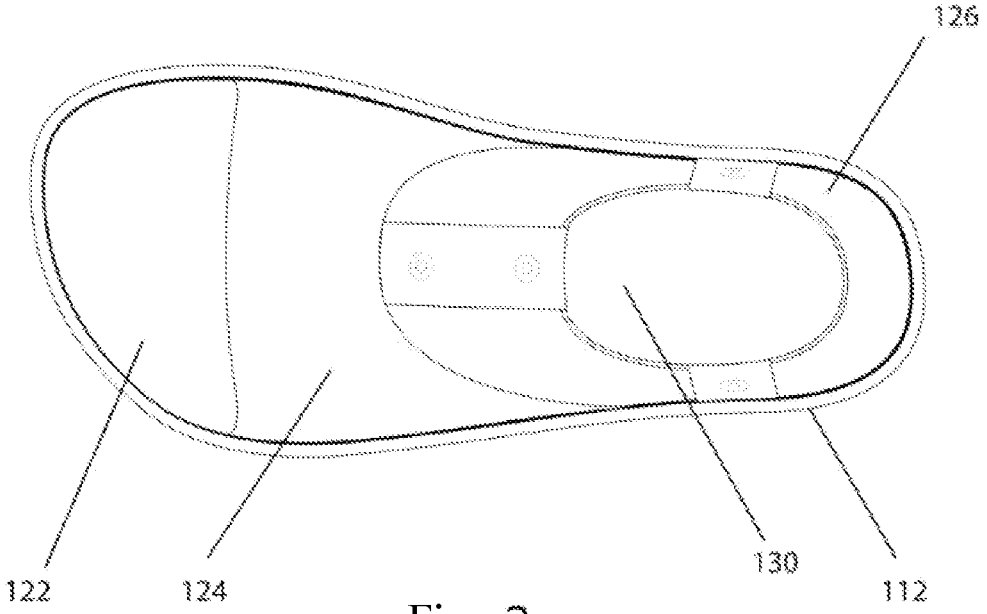
FIG. 2 shows a top view of the footwear of FIG. 1.
Figure 3:
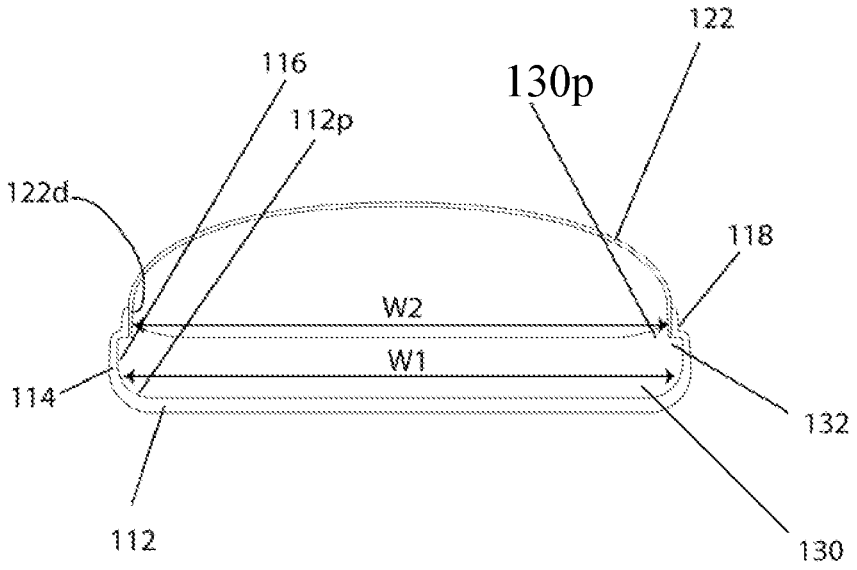
FIG. 3 shows a cross-sectional view of the shoe of FIG. 1 along the line A-A.

Turning to FIGS. 1-3 a footwear 100 in a first, shoe, configuration is shown. While reference is made to one of the left and right shoe of the pair of shoes, the following disclosure is relevant to both the left and right shoe. In general, a shoe 100 can include a sole 110 and an upper 120. As shown, the sole 110 can have an outsole 112, or outer sole, which includes a lower surface 112*d* having a textured surface, not shown, which can provide added traction for the user of the footwear on a variety of floor types. The outsole 112 can act like a shell or carrier for the inner midsole 130 and can be made of any suitable material. The outsole 112 can have a generally "foot" shape which can be manufactured in a variety of standard shoe sizes. The outsole 112 can be manufactured from any material, including rubber, foam, rigid or flexible plastics, other polymers, or any suitable material. As shown in FIG. 3, extending upward from an upper surface, or interior surface, 112*p* of the outsole 112, a perimeter wall 114 can define a recess sized and configured to receive a midsole 130, as discussed further below. The interior surface 116 of the perimeter wall 114 can have a first width W1 at a lower end thereof and a second width W2 and an upper end thereof. The second width W2 can be smaller than the first width W1 to define a retention lip 118. The retention lip 118 can extend inward along the entire perimeter wall 114 and be sized and configured to retain a midsole 130 therein. In some embodiments, the retention lip 118 can have a generally "L" shape. In an alternative embodiment the retention lip 118 may extend around only a portion of the perimeter wall 114, for example, only at the front of the footwear 100 proximate a toe box 122.

Disposed within the outsole 112, a midsole 130 can be disposed. The midsole 130 can be made of foam or other materials which can provide cushioning. The midsole 130 can generally be foot shaped to match the outsole 112. The midsole 130 can provide the wearer with added cushioning when received within the outsole 112. Advantageously, the midsole 130 of the instant footwear is designed to be repetitively removed and secured in the outsole 112. As shown in FIG. 3, the upper edge 130*p* of the midsole 130 can include an "L" shaped groove, or retaining feature, 132. The midsole 130 can have a first outer dimension which can be larger than a second upper dimension to define the "L" shaped groove 132. The "L" shaped groove 132 can be an inverse of the "L" shaped retention lip 118. The "L" shaped groove 132 and the "L" shaped retention lip 118 can both be sized and arranged to mate with one another to permit the outsole 112 to retain the midsole 130 therein. Alternatively, the midsole 130 can be retained within the outsole 112 with a variety of other mechanical fastening configurations or mechanisms. For example, as noted above, the retention lip 118 may only extend around a portion of the perimeter wall 114, thus, the "L" shaped groove 132 can similarly extend around only the same length and location around the midsole 130. In another alternative embodiment, the midsole 130 can be retained in the outsole 112 with a tongue and groove configuration, with a tongue portion extending outward from a perimeter of the midsole 130 and a groove extending outward into the outsole, from the interior. Such a tongue and groove connection can extend the entire perimeter, or only at select locations, e.g. the front of the footwear 100 proximate the toe box 122. In a further example, the midsole 130 can be retained within the outsole 112 with magnets. Alternatively, the midsole 130 can include a plurality of projections, not shown, disposed around the periphery which are sized and configured to be received within openings, not shown, in the perimeter wall 114 of the outsole 112. In a further alternative, the midsole 130 can include a plurality of recesses, not shown, sized and configured to receive projections, not shown, extending inward from the outsole 112. In yet another alternative, the midsole 130 can be retained within the outsole 112 by means of snaps, buttons, hook and loop fasteners, magnets, or any other repeatable releasable mechanical fastener.

In some embodiments, a cavity, not shown, can be disposed under the midsole 130, proximate to the toe box 122 of the shoe. As will be discussed further below, the cavity can be sized and arranged to receive material from the front toe box, toe box, toe box vamp, or front vamp portion, 122 when the shoe is in a sandal configuration.

Figure 8:
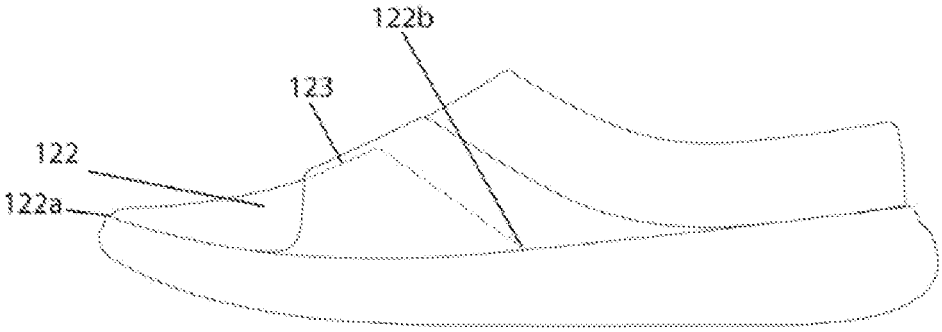
FIG. 8 shows the arrangement of the front vamp and upper of the footwear of FIG. 1.

Extending upward from the perimeter wall 114 of the outsole, a plurality of panels of textile, designated by the toe box 122 and mid-fixed strap portion 124, and can extend upward to create the upper 120 of the shoe which can, in various configurations, retain the shoe 100 on the foot of a wearer. The plurality of panels can all be made of a single material or a plurality of materials. For example, the panels can be made of mesh, textile, cotton, synthetic materials, foam, leather, or other similar materials. The upper can include a toe box vamp 122, a mid-fixed strap portion 124, and a heel 126 portion having a collar 140. The mid-fixed strap portion 124 can additionally be referred to as a panel of textile, a shoe upper portion, or an upper. In the illustrated embodiment, the toe box vamp 122 is a separate panel of material from the mid-fixed strap portion 124 and heel portion 126. In the illustrated embodiment, the toe box 122 is manufactured from a flexible material. The toe box vamp 122 can have a generally "dome" shape when in the shoe configuration. A distal edge 122*d* of the toe box 122 can be secured to the "L" shaped lip 118 of the outsole 112 such that the distal edge of the toe box 122*d* can be retained between the outsole 112 and the midsole 130, when the midsole 130 is retained in the outsole 112. For example, the distal edge of the toe box 122*d* can be stitched, glued, or otherwise affixed, to the "L" shaped lip 118. As seen in FIG. 8, the toe box 122 can extend from a first end 122*a* of the footwear to a second point 122*b* along the outsole 112. In some embodiments, the toe box 122 can extend approximately 20-80% of the length of the footwear 100. The front toe box 122 can extend underneath the fixed strap portion 124, such that in the shoe configuration, the toe box 122 extends upward over the user's toes and the fixed strap portion 124 extends upward over at least a portion of the toe box 122. The overlap portion 123 of the toe box 122 and fixed strap portion 124 can ensure that the user's foot remains covered during use in at least the shoe configuration, as seen in at least FIGS. 1 and 2.

Similar to the toe box 122, the mid-fixed strap 124 and heel portion 126 can be a single piece of material or multiple pieces of material. For example, the material can be a textile, a synthetic, leather, mesh, etc. In alternative embodiments, the mid-fixed strap and heel portions can be two, or more, distinct panels of material. For example, the mid-fixed strap 124 can be manufactured from a foam and the heel portion 126 can be manufactured from a flexible material. In a further alternative, the mid-fixed strap 124 and heel portions 126 can be manufactured from a more rigid material such as foam, and the collar 140 can be manufactured from a flexible textile. Similar to the toe box 122, a distal edge of the upper 124 can be retained on the "L" shaped lip 118 of the outsole 112 with glue, stitching, or a combination thereof. The mid-fixed strap 124 and heel portion 126 can extend 80-90% of the length of the shoe 100 from the rear of the shoe towards the toe box 122. In some embodiments, the heel portion 126 of the footwear can include a counter, or support, to provide structure and strength of the back part of the shoe 100 to help the footwear maintain its shape. The counter, not shown, can extend upward from the outer sole approximately halfway up the height of the heel portion 126. The portion of the heel 126 that does not include a counter can be considered the collar 140, which can be flexible. In an alternative embodiment, the counter can be eliminated entirely. In such an alternative embodiment, a user can easily fold the collar 140 and heel portion 126 downward and forward, towards the toe box 122, to create a slide on "clog" or sandal configuration. In addition, the portion of the heel 126 that is folded downward can be retained underneath the midsole 130. For example, the midsole 130 can be removed from the outsole 112, the heel 126 can be folded downward to the interior surface 112*p* of the outsole 112, and the midsole 130 can be re-inserted into the outsole 112 to obscure the folded portion of the heel 126. Alternatively, the folded portion of the heel 126 can rest on the upper face of the midsole 130 directly, without removing the midsole 130.

Figure 13:
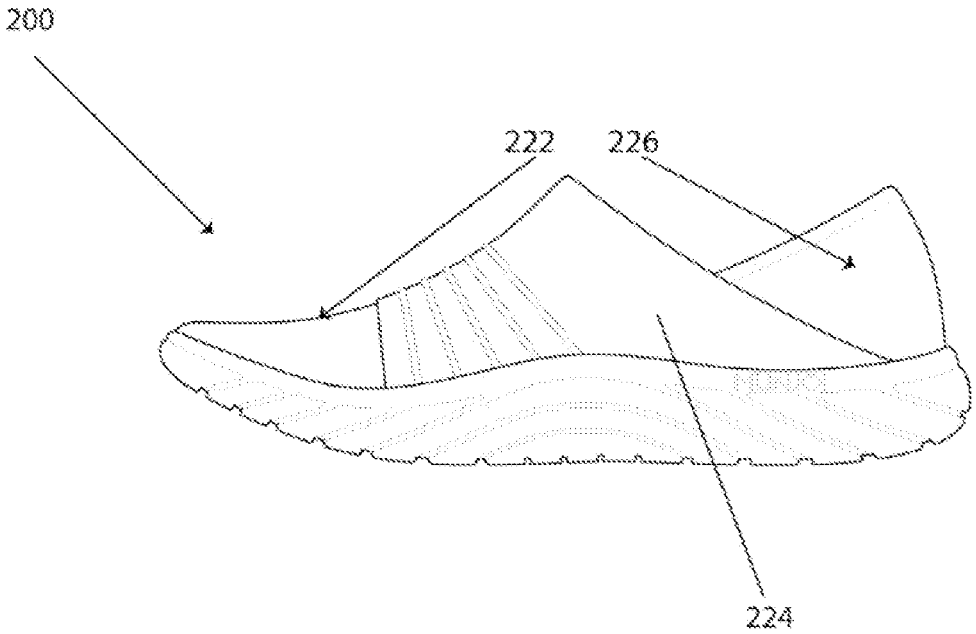
FIG. 13 shows an elevation view of an alternative footwear.

In an alternative footwear 200, as shown in FIG. 13, the shoe 200 can include a toe box 222, an upper portion 224, and a heel portion 226. In the illustrated embodiment, the shoe 200 can be similar to the shoe 100, except for the heel portion 226. For example, the heel portion 226 can be a distinct portion of material from the upper 224. The heel portion 226 can be attached to the outsole and disposed, at least partially, interior to the upper portion 224. This arrangement of the heel 226 inward of the upper 224 can allow for the heel 226 to be folded downward towards the outsole or midsole, not shown, and folded down such that it is flat to create a clog configuration. Alternatively, the midsole can be removed and the heel portion 226 can be folded downward, then the midsole can be reinserted, as discussed above with respect to footwear 100.

Figure 4:
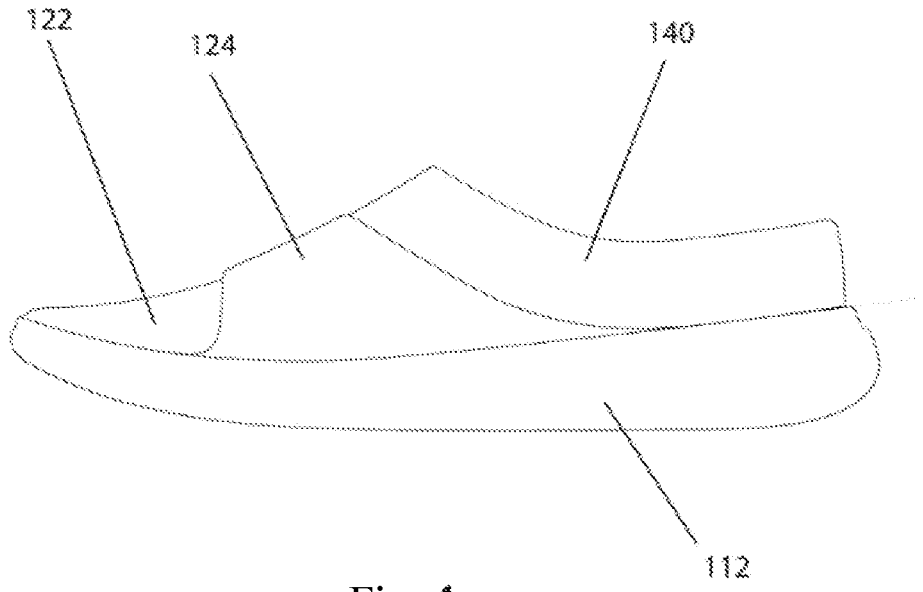
FIG. 4 shows a side elevation view of the footwear of FIG. 1 in a slipper configuration.
Figure 5:
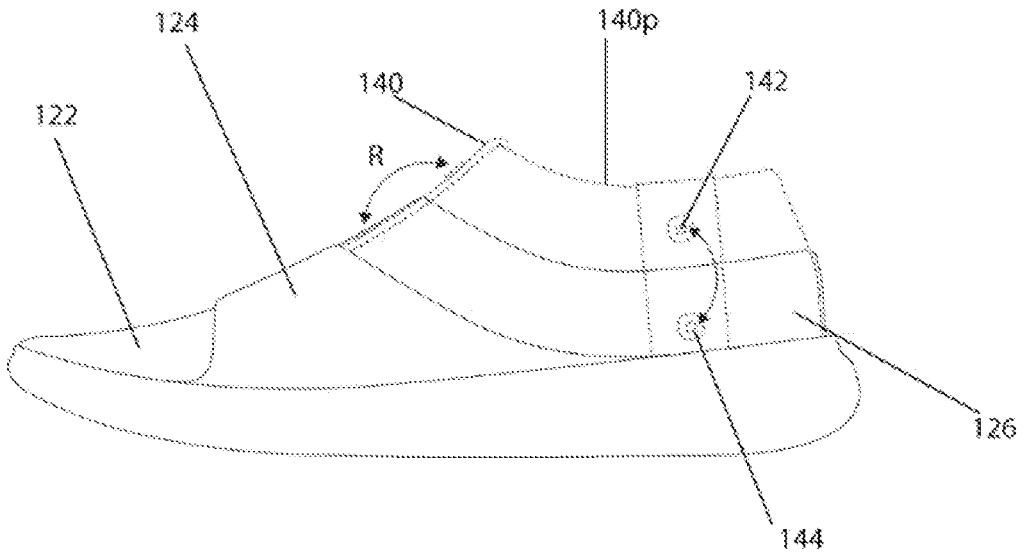
FIG. 5 shows a side elevation view of one embodiment of converting the footwear of FIG. 1 to the slipper configuration of FIG. 4.

As shown in FIGS. 1-3, the collar 140 of the heel portion 126 can have any desired height. For example, the collar 140 can extend upward from the heel portion 126 to create a shoe like configuration. Alternatively, the collar 140 can be a relatively short "ankle" height size. On the outer surface of the collar 140 there can be retaining features 142, 144 which can retain the collar in the slipper configuration. For example, as shown in FIGS. 4 and 5, the proximal end of the collar 140*p* can be rolled outward and downward, in the direction R, towards the outsole 112. The retaining features 142, 144 can be used to fix the collar in this configuration. In some embodiments, the retaining features 142, 144 can be a button, snap, hook and loop mechanism, magnets, or other mechanical fasteners.

Figure 6:
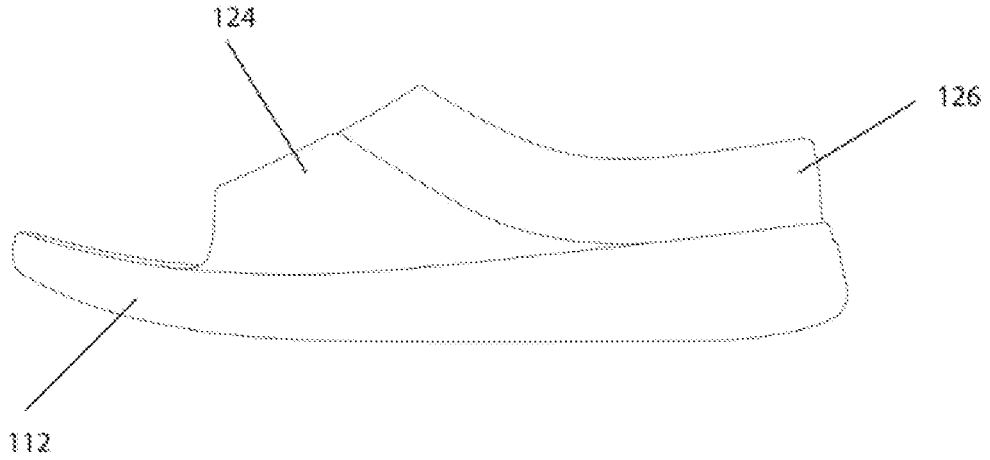
FIG. 6 is a side elevation view of the footwear of FIG. 1 in one sandal configuration.
Figure 7:
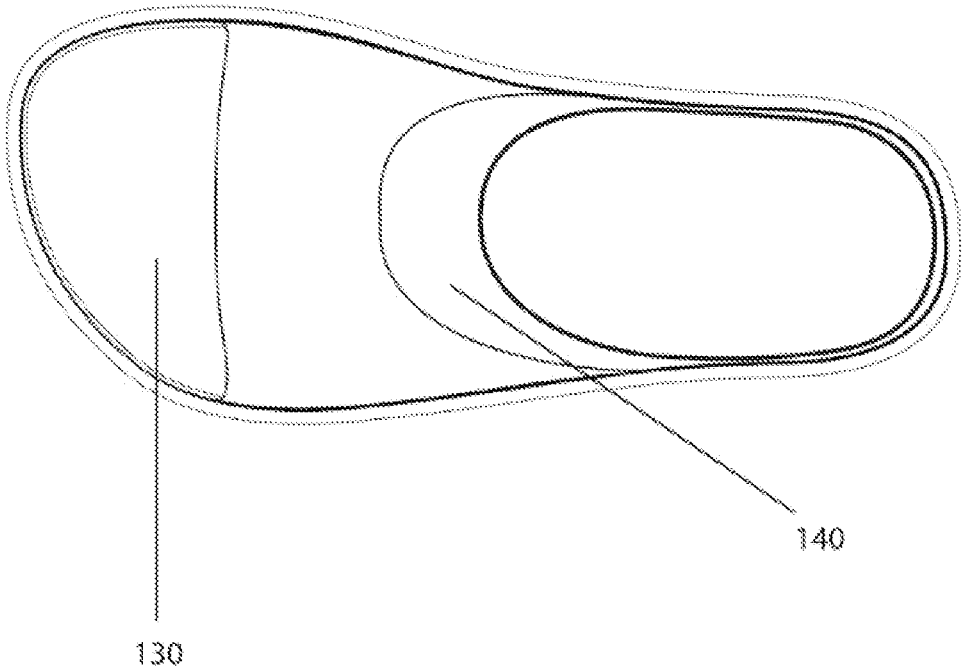
FIG. 7 is a top view of the sandal of FIG. 6.

In use, the footwear 100 of the present invention enables the conversion of a shoe/sneaker, as seen in FIGS. 1 and 2, into a slide/slipper, as shown in FIGS. 4 and 5, to a sandal configuration, as shown in FIGS. 6 and 7. As discussed below, the various configurations can be mixed and matched to accommodate the various needs of the user. For example, the sandal configuration can have the heel portion completely depressed against the midsole, can be rolled down into the slide configuration, or can even be fully extended as in the shoe configuration. There are no pieces that need to be removed or detached and separately stored to carry out the conversion. The entire footwear can remain intact and can be converted quickly and easily at any location.

Figure 9:
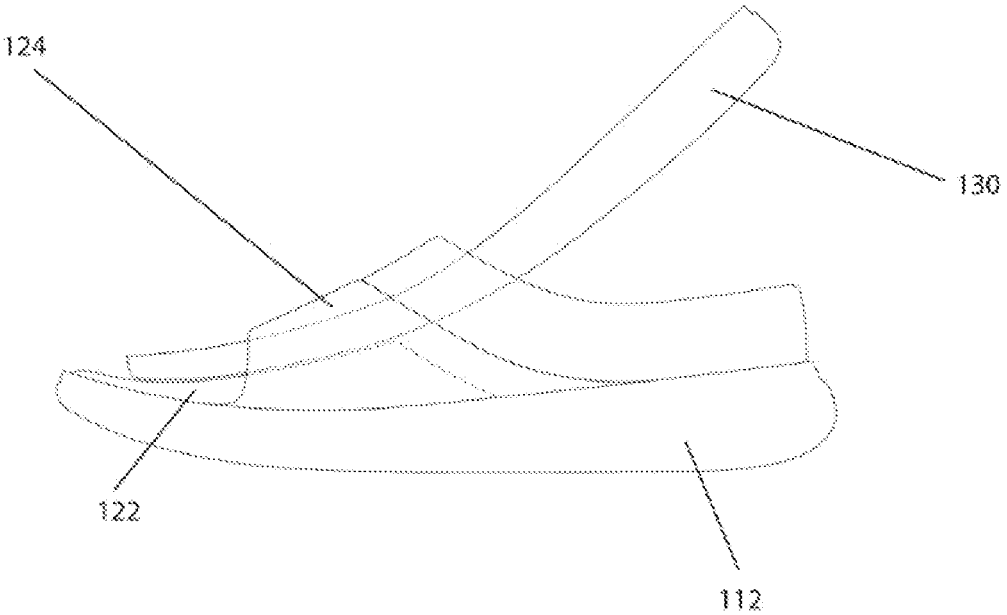
FIGS. 9-11 show one embodiment of how the footwear of FIG. 1 is converted to the sandal of FIG. 6.
Figure 11:
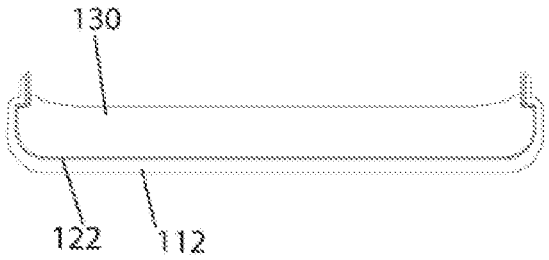
Figure 12:
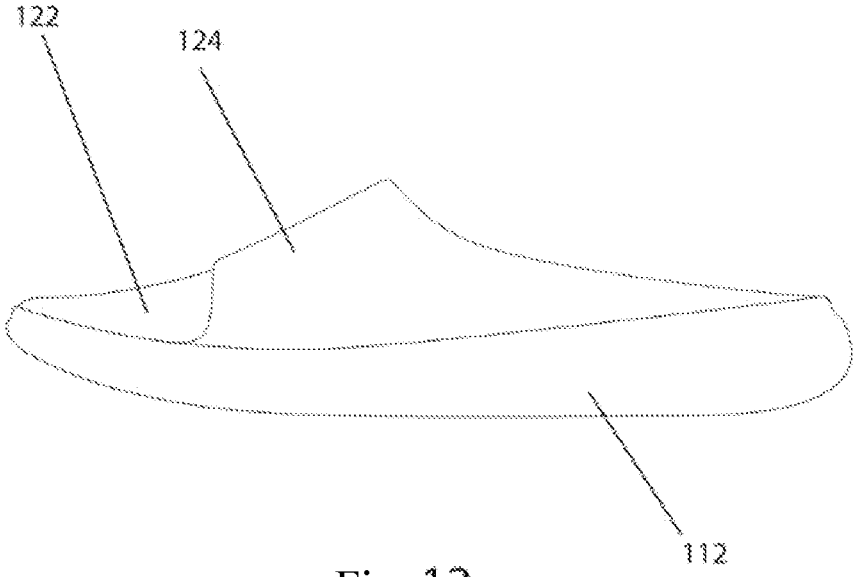
FIG. 12 shows an elevation view of the footwear of FIG. 1 in a clog configuration.

Turning now to FIGS. 4 and 5, the conversion of the footwear of the present invention from the shoe to the slide/slipper configuration is shown in detail. As shown in phantom in FIG. 5, the rear collar portion of the shoe upper may be elongated so it can extend upward. The collar portion can be flexible enough that it can be rolled or folded downwardly, in the directions R, shown as arrows in FIG. 5, to lower the height of the collar of the shoe when converting to sandal/slide. As noted above, the collar 140 can include snaps 142, 144 which can help in retaining the collar in this configuration, though this is not required. In an alternative embodiment, the collar 140 can be folded downwardly and inwardly such that it is retained in an interior of the shoe upper. As noted above, the heel portion 126 may not include a counter support. Thus, the clog configuration can additionally have the heel portion 126 folded downward towards the toe box 122 and the midsole 130, as shown in FIG. 12. In such a configuration, the user can just slide their foot into the shoe. In a further alternative, the midsole 130 can be removed from the outsole 112, as shown in FIG. 9 for example, then the heel portion 126 can be folded downward towards the upper, interior, surface of the outsole 112; then, the midsole 130 can be put back into place above the folded down heel portion. Such a configuration can advantageously retain the shoe in the desired configuration. The user of the shoes can continue to use the shoe in this configuration, or additionally or alternatively, reconfigure the shoe to "remove" the toe box to create a sandal. While the term "remove" is used for ease of discussion, the actual toe box remains part of the shoe but is folded down, as shown in FIG. 11.

Figure 10:
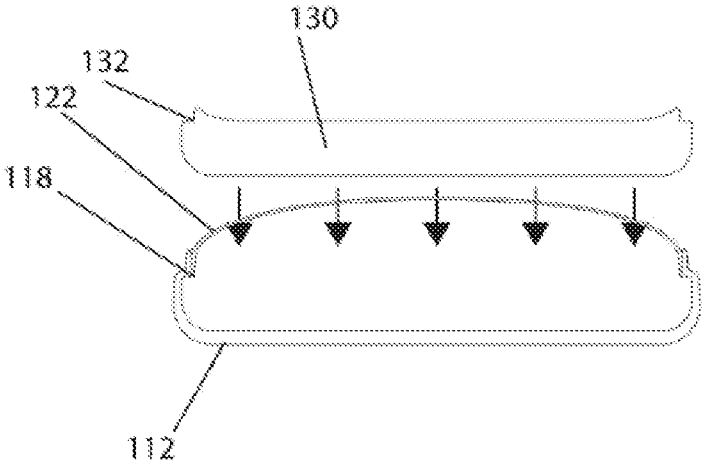

As discussed above, the front toe box 122 section of the shoe upper 120 is preferably made of mesh or textile and secured to the outer sole 112. Moreover, the toe box 122 can be free floating underneath the fixed strap 124 in the middle zone of the shoe upper 120, as best seen in FIG. 8. As can be seen in FIGS. 6-11, for conversion to a sandal configuration a first step can include the removable of the midsole 130 from the outer sole, shown schematically in FIG. 9. The front vamp portion 122 can then be downwardly flexed in a direction F, as shown in FIG. 10, so that it collapses and then nests into the outer sole 112. The midsole 130 can then be replaced back into the outer sole 112 to rest over the nested front vamp portion 122. In some embodiments, the front vamp portion 122 can be retained in a cavity underneath the midsole 130. The front vamp portion 122 is thereby "hidden," as shown in FIG. 11, without removing or adding any components, as in the prior art. In this condition, the shoe upper portion 124 remains in an elevated position to receive the foot of the wearer whereby the toes of the wearer are exposed thereby achieving the desired sandal configuration. Further, the wearer's toes are able to rest on the midsole itself, while being exposed. In an alternative embodiment, the front vamp portion 122 can be downwardly flexed, without the removal of the midsole 130 such that the user's toes rest on the flexed material of the front vamp 122. The sandal configuration and the clog configuration can be combined, such that both the heel portion 126 and the toe box 122 are both collapsed, either onto the midsole or under the midsole, or a combination thereof. The process to reverse any of the above noted changes from one configuration to another, the wearer merely reverses the above noted steps.

The sizing, dimensions and configuration of the footwear of the present invention and the materials used therefor may be modified, as desired, and will still be within the scope of the present invention.

Therefore, the footwear of the present invention successfully provides both a shoe and sandal in one product and solves the problem of having to carry around any extra pieces or separate footwear articles. Most notably, the footwear of the present invention eliminates the need for carrying around a secondary attachment piece to be used as a closed toe covering because it is integrated into the footwear structure and is never detached. As a result, the wearer will be able to change the footwear article from a shoe to a sandal where ever they are on the go without needing to carry any extra pieces or separate footwear articles and is an "all in one" footwear.

It would be appreciated by those skilled in the art that various changes and modifications can be made to the illustrated embodiments without departing from the spirit of the present invention. All such modifications and changes are intended to be covered by the appended claims.

What is claimed is:

1. A convertible footwear, comprising:

an outer sole having a cavity and at least one retaining feature;

a removable midsole residing in the cavity of the outer sole and having at least one complementary retaining feature;

a shoe upper connected to the outer sole having a fixed mid-section;

a front vamp portion flexibly connected to the outer sole; the front vamp portion having a first position that is elevated to cover a wearer's toes and having a second position with the front vamp portion residing in the cavity of the outer sole and between the midsole and the outer sole, wherein the shoe upper is in an elevated position, above the removable midsole, when the front vamp portion is in both the first position and the second position.

2. The convertible footwear of claim 1, wherein a material of the front vamp portion and the shoe upper are different.

3. The convertible footwear of claim 1, wherein the front vamp portion is made of mesh.

4. The convertible footwear of claim 1, wherein the shoe upper further comprises a flexible collar portion, and wherein the flexible collar portion is flexibly movable and has a first extended position and a second folded position.

5. The convertible footwear of claim 4, wherein a height of the flexible collar portion is lower in the second folded position than in the first extended position.

6. The convertible footwear of claim 4, wherein the flexible collar portion is made of a different material than the remainder of the shoe upper.

7. The convertible footwear of claim 4, wherein the flexible collar portion is disposed proximate a heel portion of the footwear, wherein the heel portion is disposed at an opposite end of the footwear from the front vamp portion, and wherein the heel portion does not include a counter support.

8. The convertible footwear of claim 1, wherein the shoe upper extends above and over a portion of the front vamp portion in both the first and second positions of the front vamp portion.

9. The convertible footwear of claim 1, wherein the footwear is configured and arranged such that all portions of the footwear are maintained on the footwear in both the first and second positions of the front vamp portion.

10. The convertible footwear of claim 1, wherein the midsole is releasably retained in the cavity of the outer sole by engagement of the complementary retaining feature in the retaining feature.

11. The convertible footwear of claim 1, wherein the front vamp portion and the shoe upper are retained against the retaining feature.

12. The convertible footwear of claim 11, wherein a portion of the front vamp portion and a portion of the shoe upper are retained between the outer sole and the midsole.

13. A method for converting footwear, the method comprising, providing at least one footwear including an outer sole having a cavity, a midsole disposed in the cavity, a shoe upper connected to the outer sole having a fixed mid-section; and a front vamp portion flexibly connected to the outer sole;

removing the midsole from the outer sole, flexing the front vamp from a first position that is elevated to cover a wearer's toes to a second position with the front vamp portion residing in the cavity of the outer sole, and re-inserting the midsole in the cavity above the front vamp, wherein the shoe upper is in an elevated position, above the removable midsole when the front vamp portion is in both the first position and second position.

14. The method of claim 13, wherein a material of the front vamp portion and the shoe upper are different.

15. The method of claim 13, wherein the front vamp portion is made of mesh.

16. The method of claim 13, further comprising folding a flexible collar portion of the shoe upper from a first extended position to a second folded position, wherein a height of the flexible collar portion is lower in the second folded position than in the first extended position.

17. The method of claim 16, wherein the flexible collar portion is made of a different material than the remainder of the shoe upper.

18. The method of claim 13, wherein no portion of the footwear is removed once the midsole has been reinserted.

19. The method of claim 13, wherein the front vamp portion is retained between the midsole and the outer sole after the flexing and re-inserting steps.

* * * * *